US005951001A

United States Patent [19]

Stradi

[11] Patent Number: 5,951,001

[45] Date of Patent: Sep. 14, 1999

[54] DEVICE FOR RAISING AN EDGE OF A TOPMOST SHEET OF A PILE OF SHEETS

[75] Inventor: Aristide Stradi, Soliera, Italy

[73] Assignee: A.S.T System Automation di Stradi A. & C. S.n.c., Soliera, Italy

[21] Appl. No.: 08/907,621

[22] Filed: Aug. 12, 1997

[30] Foreign Application Priority Data

Mar. 1, 1995 [IT] Italy ..... MO95A0028

[51] Int. Cl.[6] ..... B65H 3/22

[52] U.S. Cl. ..... 271/18.3; 271/98; 271/107; 271/106; 271/104

[58] Field of Search ..... 271/20, 19, 106, 271/18.3, 107, 98, 104; 221/213

[56] References Cited

U.S. PATENT DOCUMENTS

| | | | |
|---|---|---|---|
| 3,813,094 | 5/1974 | Walton et al. | 271/18.3 |
| 3,981,495 | 9/1976 | Bijttebier | 271/18.3 |
| 4,009,786 | 3/1977 | Littlewood | 271/18.3 |
| 4,576,560 | 3/1986 | Herman . | |
| 4,968,019 | 11/1990 | Tanabe et al. | 271/106 |

FOREIGN PATENT DOCUMENTS

| | | | |
|---|---|---|---|
| 7992075 | 10/1986 | Australia . | |
| 0165019 | 12/1985 | European Pat. Off. | 271/18.3 |
| 0421167 | 4/1991 | European Pat. Off. . | |
| 0002542 | 1/1980 | Japan | 271/18.3 |
| 403086598 | 4/1991 | Japan | 271/106 |
| 001675175 | 9/1991 | U.S.S.R. | 271/18.3 |
| 2143508 | 2/1985 | United Kingdom . | |

*Primary Examiner*—H. Grant Skaggs
*Attorney, Agent, or Firm*—Browdy and Neimark

[57] ABSTRACT

A device for raising an edge of a topmost sheet from a pile of sheets comprises two cursors slidably coupled to a mobile head. On one end of each cursor two needles are fixed, which needles pierce into said edge. The device is especially useful in the manufacturing process of phenolic-melaminic decorative plastic laminates and preformable or postformable treated panels for raising sheets of paper which have been impregnated with resin and piled one on another.

10 Claims, 4 Drawing Sheets

7
22
23
22
23
7
21
21
12
12
27
28
9
27
α
α

2
4
13
4a
3
3
3

18
24
6
29
4
26
25
13
15
34
16
14

32
2
3
35
3
3
31
4
5
33

DEVICE FOR RAISING AN EDGE OF A TOPMOST SHEET OF A PILE OF SHEETS

BACKGROUND OF THE INVENTION

The invention relates to a device for raising an edge of a single sheet situated topmost on a pile of sheets.

Specifically, but not exclusively, it is useful for raising resin-impregnated paper sheets arranged in a pile one on top of another. This operation is performed, for example, in the manufacture of phenolic-melaminic decorative plastic laminated sheets, or in the field of treated post-formable or pre-formable panels. Both of the aforementioned operations involve feeding of paper from a roll into an impregnating machine; after which the paper is cut into sheets, which are then piled one on top of another to form piles.

The device of the present invention raises said sheets one-by-one from the pile, so that the sheets can be sent on to subsequent work operations. This raising operation is at present carried out by hand by one or more operatives. Even when done by hand the separating of the sheets is problematic. The tendency of resinated sheets is to stick together, forming an undesirable compacted block, which obviously increases in stickiness and compactability with the quantity of resin used in the operation and therefore absorbed by the paper. The weight of the pile also increases with the degree of resination of the paper: a typical pile can be formed by 1500 to 2000 sheets, and can weigh up to 2000 Kg. If a pile is left undisturbed for a considerable time, the compactness of the pile becomes even more of a problem as the resin dries.

A further drawback in the prior art is the amount of labour time required and the subsequent slowness of the laminate or panel formation.

In the field of treated panels the prior art teaches a device equipped with suckers to raise the sheet situated on top of the pile. It is still necessary, however, for an operative to detach the topmost sheet from the underlying one before replacing it in the same position at the top of the pile; only then can the sheet can be raised by the suckers.

SUMMARY OF THE INVENTION

The main aim of the present invention is to obviate the abovementioned drawbacks in the prior art by providing a device for raising a predetermined number of sheets from a pile, where the sheets to be raised tend to stick together.

An advantage of the invention is that it is constructionally simple and economical.

A further advantage is that with the invention sheets of large dimensions can be raised simply, rapidly and reliably. The device is suitable for sheets of any dimension.

The invention is also suitable in situations where the piles do not exhibit a perfectly flat and horizontal upper surface. This happens, for example, when a rest surface or pallet bearing the piles is not in perfect condition, and the pile of sheets is angled in relation to the ground—or where (common where very large sheets are concerned) the pile of sheets presents an area of a concavity towards the centre of the sheets.

A still further advantage is that the device can be commanded to raise more than one sheet at a time. The device is also capable of raising a high number of sheets per unit of time.

The above aims and advantages and others besides are all attained by the device of the invention, as it is characterized in the accompanying claims.

Further characteristics and advantages of the present invention will better emerge from the detailed description that follows, of two embodiments of the invention, illustrated in the form of non-limiting examples in the accompanying drawings.

Figure 1:
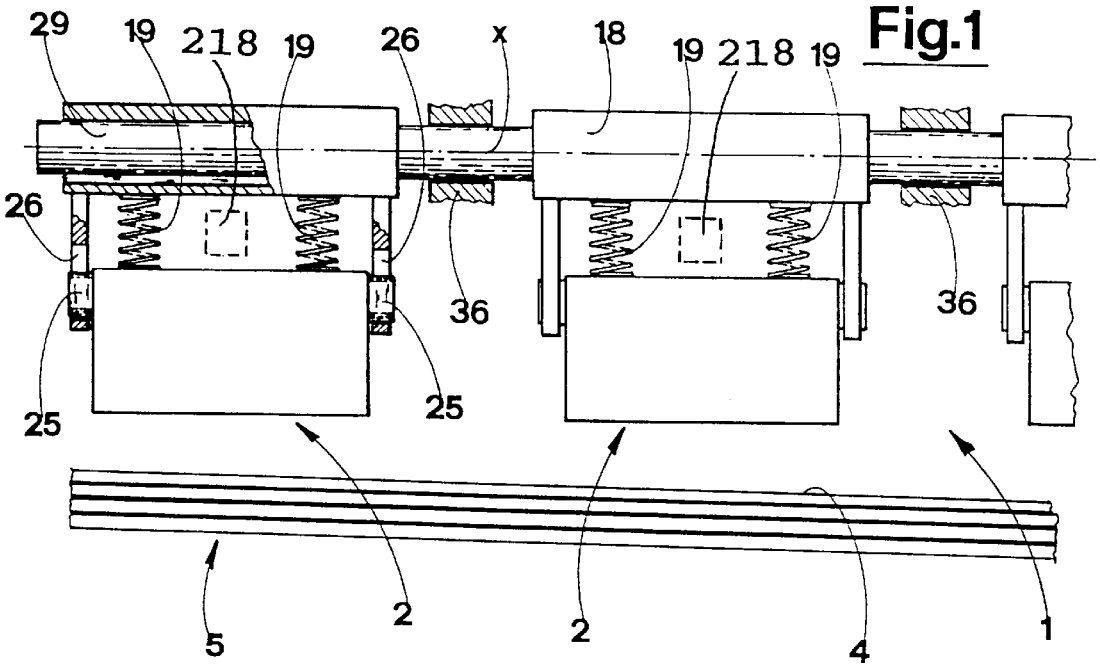
FIG. 1 schematically shows a vertical-elevation frontal view of a part of the device, with some parts removed better to evidence others and further evidencing an upper part of a pile of sheets.

With reference to the FIGS. from 1 to 5, 1 denotes in its entirety a device for raising an edge 4 of a sheet 13 situated at a top of a pile 5 of sheets. The external side of a sheet is indicated by 4*a*.

DESCRIPTION OF THE PREFERRED EMBODIMENTS

In the examples the pile is represented by sheets of paper of the "Kraft" type, impregnated with phenolic resins and of the type utilized in the manufacture of decorative plastic laminates or post-formable or pre-formable treated panels.

The device 1 comprises a plurality of heads 2, aligned parallel to the external side 4*a* of an edge 4 of a pile 5 of sheets. In cases where the sheets 5 have at least one longer side, the heads 2 act preferably on the edge 4 of that longest side.

Each of the heads 2 is mounted on a support 18 and is slidable with respect thereto by means of a slide-coupling between pivots 25 and slots 26, with vertical mobility between a lower position and an upper position. Each head 2 is provided with at least one spring 19 which pushes the respective head downwards, retaining it in the lower position. Blocking means 218, shown schematically in FIG. 1, of known type and not illustrated in the figure, can be activated from the outside so as releasably to block the heads 2 in any position comprised between the lower position and the upper position.

The supports 18 of the heads 2 are mounted on a main shaft 29 which is rotatable with respect to a support frame 36 about an axis x which is horizontal and parallel to the line of heads 2. The support frame 36, schematically represented in the figures of the drawings, is also mobile and can be neared and distanced to and from the pile 5 of sheets.

Means (of known type and therefore not illustrated in the figures) are also provided for moving the support frame 36 and the main shaft 29. These means are utilized for commanding the following head 2 movements:

a) at least a vertical translation (with respect to the pile 5 of sheets) such as to near and distance the heads 2 to and from the upper surface of the pile 5;

b) also with respect to the pile of sheets, translation horizontally and normally to the external side 4*a* of the edge 4 (see arrow 24) such as to permit a small predetermined movement of the heads 2 towards the centre of the pile;

c) rotations about axis x with respect to the support frame 36.

Two cursors 6 are slidingly coupled with each head 2. The cursors 6 are slidable on command with respect to the head 2 between an active position (FIG. 3) and an inactive position (FIG. 2), with the sliding axis lying on a vertical plane parallel to the external side 4*a* of the edge 4 of the sheets and having an inclination α with respect to a horizontal plane. Blocking means are also provided, of known type and not shown in the figure, which can be activated from the outside in order releasably to block the cursors 6 in any position comprised between the active and inactive positions.

The two cursors 6 borne by one head 2 have opposingly set inclinations α; in particular, the inclination α of one of the cursors 6 is preferably 45 degrees, measured in a clockwise direction, while the inclination of the other of the cursors is 45 degrees measured in an anticlockwise direction. The inclination angle α can be comprised between 10 and 80 degrees.

At a lower end 20 of each cursor 6 three needles 3 are fixed and arranged in a line which is perpendicular to the external side 4*a* of the edge 4. In the active position the needles 3 project inferiorly from the head 2, while in the inactive position the needles 3 retract into the head 2. A different number and arrangement of the needles 3 can be made. Instead of needles, other piercing elements could be used.

The needles 3 are fixed to the respective cursor 6 in such a way that they extend lengthwise parallel to the cursor 6 sliding axis; the aim being that the needles 3 should be mounted on the cursor 6 in such a way as to pierce the sheet 13 at an inclination angle α. Further, the needles 3 can slide with respect to the cursor and be fixed releasably in a preselected position, for example by means of a pressure element not shown in the figures, so as to regulate the distance by which they project from the head 2.

Each head 2 is provided with a flat lower surface 17 which interacts with the edge 4. The end 20 of the cursor 6 is flat and parallel to the flat lower surface 17 of the head 2. The cursor 6 translates in such a way as to maintain the end 20 parallel to itself Each head 2 is provided with a special mechanism for bringing the cursors 6 from the inactive position to the active position when the head 2 nears the edge 4, as will be more fully explained hereinbelow.

The mechanism comprises two springs 7 and a stop device 8. Each spring 7 acts between a cursor 6 and the head 2 to bring the respective cursor into an active position. A motor is provided, constituted in the present embodiment by two pneumatic cylinders 21, each of which is connected to a cursor 6 by means of a rocker arm 22 and a rod 23 aligned with the sliding axis of the cursor 6 and operating thereon. The cylinders 21 bring the respective cursors 6 into the inactive position and thereby compress the springs 7 through the action of two projections 12, each of which is fixed to an end of a respective rod 23 and interacts with a respective cursor 6.

The stop device 8 is, in the present embodiment, constituted by a clickstop comprising two pawls 10 each of which penetrates into a housing 30 fashioned in a respective cursor 6. Each pawl 10 is journalled to the head 2 by a pivot 27 and engages with a sliding element 28 having an end 9 which interacts with said edge 4. The stop device 8 further comprises a recall spring 11 which acts on the sliding element 28 to push the pawls 10 into the housings 30. The stop device 8 also comprises blocking means, of known type and not shown in the figures, which on command releasably block the sliding element 28.

The stop device 8 blocks the cursors 6 in the inactive position; when the end 9, which projects from the lower surface 17 of the head 2, contacts with the edge 4, the stop device 8 unblocks the cursors 6.

As will be more fully described hereinbelow, the heads 2 can move in such a way that the needles 3 pierce the upper surface of the pile 5 of sheets at the edge 4 thereof, to a predetermined depth, which will usually be a depth corresponding to the breadth of the topmost sheet 13 in the pile 5, as the sheets are normally removed one at a time. Should it be necessary to raise more than one sheet at a time, the needles 3 will obviously be set to penetrate more deeply into the pile 5.

The needles 3 of one head 2 pierce into the topmost sheet 13 or sheets at opposing and equal inclination angles α with respect to the pile 5.

The device 1 further comprises means for detaching the topmost sheet 13 from the underlying sheets 14. The means for detaching comprise pliers 15 which grip the edge 4 raised by the heads 2 and drag away the raised topmost sheet 13.

The means for detaching could comprise, in another embodiment, a slim element such as a tensed wire 16 stretched parallel to the edge 4, which wire on command would pass between the topmost sheet 13 and the underlying sheets 14 starting from the edge 4 and passing below the topmost sheet 13 up to the opposite edge thereof. The topmost sheet 13 would still be in its original position at the end of this operation, but by now would be detached from the underlying sheet 14 and could be removed by means of a device incorporating suckers.

A further embodiment might advantageously employ means, such as a blower 34 for generating an air cushion between the topmost sheet 13 and the underlying sheet 14 after the wire 16 has been passed through.

There now follows a description of a work cycle of the device 1 as it is embodied in FIGS. from 1 to 5.

The gripping cycle of a sheet starts from the configuration as shown in FIG. 1, wherein the heads 2 are distanced from the pile 5 of sheets and the cursors 6 are in the inactive position with the springs 7 compressed. At this point the heads 2 are neared to the topmost sheet 13 of the pile at a position corresponding to the edge 4 thereof, up until when the lower surface 17 of the heads 2 touch the pile. At the same time the pawls 10 are unblocked due to the fact that the end 9 of the stop device 8 lifts following contact with the pile 5 of sheets.

As soon as the end 9 returns into the flat surface 17 of the head 2, the cursors 6 are pushed by the springs 7 into the active position, such that the needles pierce the edge 4 of the upper sheets 13. Once the cursors 6 of each head 2 are in the active position, the means for blocking the heads 2, the cursors 6 and the sliding element 28 are actuated.

At this point the edge 4 of the topmost sheet 13 is raised by rotating the support 18 of the heads about axis x and at the same tune causing the support frame 36 to move slightly towards the centre of the pile 5 (as indicated by arrow 24).

Thanks to the composition of the above-mentioned movements the edge 4 of the topmost sheet 13 is raised surely and reliably, without risk of damaging the paper. Thereafter the means for detaching the topmost sheet 13 from the underlying sheet are actuated.

When the means for detaching comprise the pliers 15, the detachment operation is carried out as follows: the raised edge is gripped by the pliers 15; the cursors 6 are unblocked and returned to the inactive position; the heads 2 are raised to allow the pliers 15 to pass, said pliers 15 (now gripping the sheet) being moved towards the opposite edge of the sheet 13 such as to detach the sheet 13 completely.

When the means for detaching comprise the wire 16 and the blower 34, the detachment operation is carried out as follows: the wire 16 is passed between the topmost sheet 13 and the next sheet in the pile 5; an air cushion is generated by the blower 34; the cursors 6 are unblocked and returned to the inactive position; the heads 2 are distanced in order to avoid any interference with the sucker device.

When the cursors 6 have been unblocked and returned into the inactive position by means of the cylinders 21, the needles 3 exit from the topmost sheet 13 and the springs 7 are automatically reloaded ready for the next operative cycle.

After the heads 2 have been distanced from the topmost sheet 13, the sliding element 28 is unblocked and the pawls 10 return automatically into the housings 30, due to the pressure of the recall spring 11; thus the cycle is concluded.

The means for blocking the sliding element 28 prevent the end 9, pushed by the recall spring 11, from causing the needles 3 to lose grip on the topmost sheet 13 after the edge 4 has been raised.

The special coupling between the heads 2 and the support 18 ensures that all the heads 2 contact with the upper surface of the pile, even when the latter is not perfectly flat and horizontal, thus ensuring that all the cursors 6 are actuated.

Thanks to the mechanism comprising the springs 7, pneumatic cylinders 21 and the stop device 8, the needles 3 pierce the topmost sheet 13 at the moment when the head 2 is completely in contact with the pile 5, thus ensuring a good grip.

Figure 2:
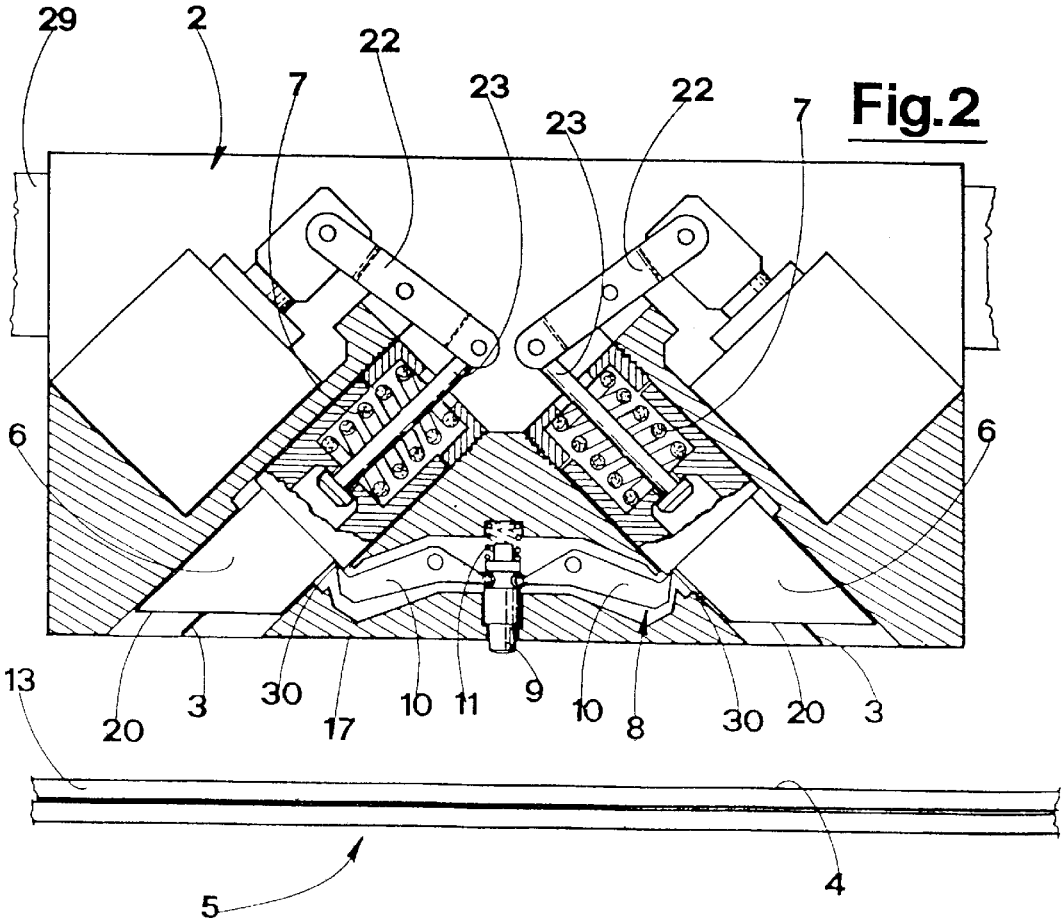
FIG. 2 shows in enlarged scale a detail of FIG. 1 with some parts removed better to evidence others.
Figure 3:
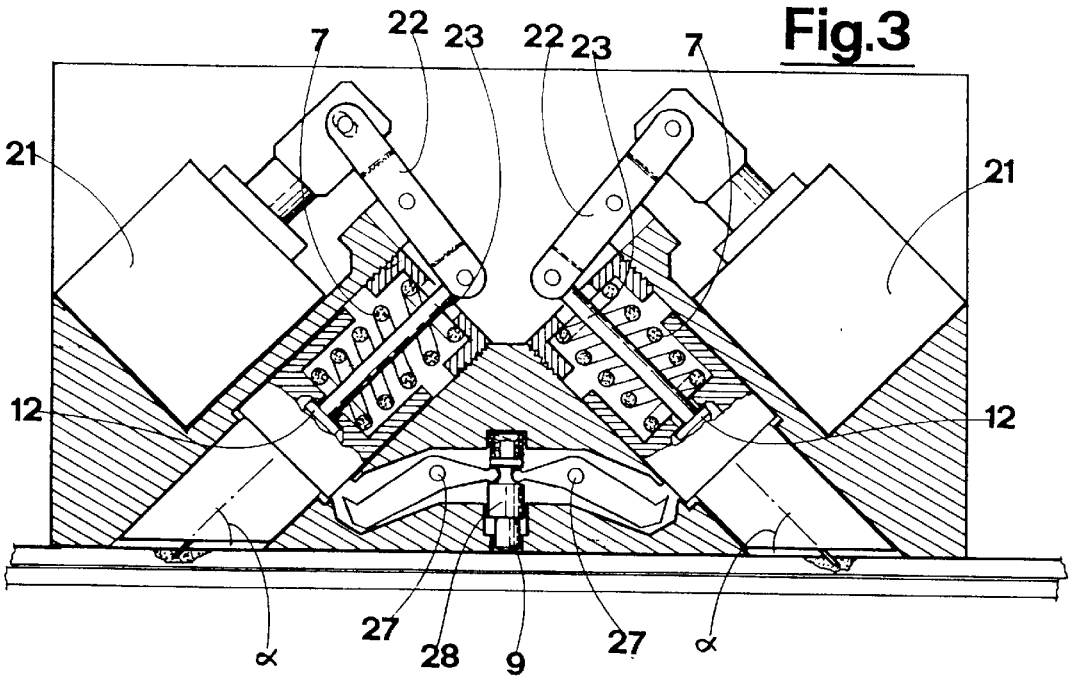
FIG. 3 shows the view of FIG. 2 with the head 2 in a different configuration.
Figure 4:
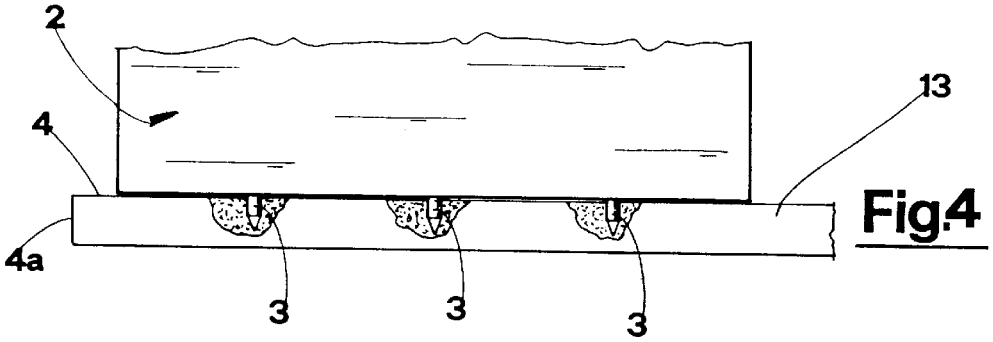
FIG. 4 is a partial lateral view from the right of FIG. 3 with some parts removed better to evidence others.
Figure 5:
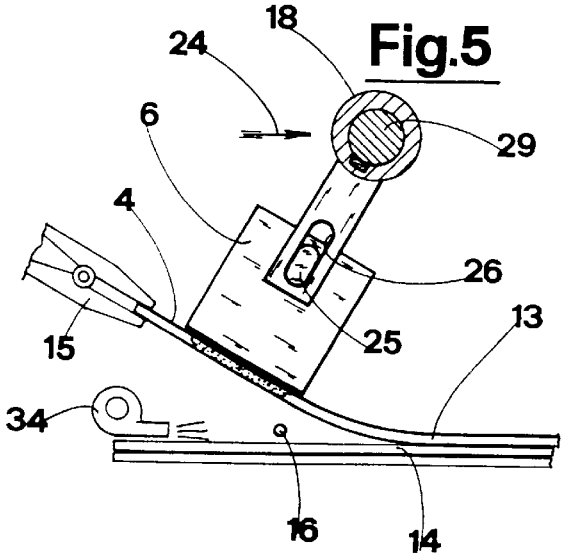
FIG. 5 shows in reduced scale the view of FIG. 4 with the head 2 in a different configuration.

Should the edge 4 be shorter than the line of heads 2, the cylinders of the external heads not interacting with the edge 4 are deactivated and stay in the position shown in FIG. 2 for the duration of the whole operation.

Figure 6:
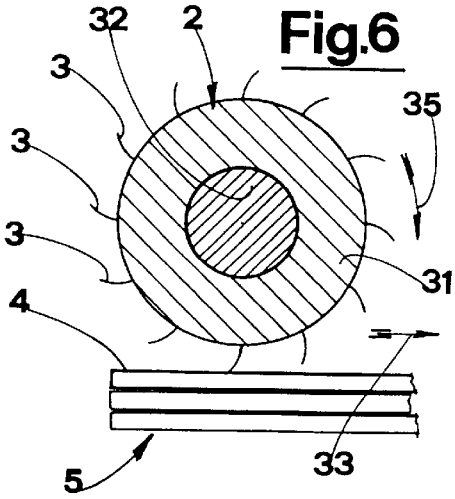
FIG. 6 is a schematic vertical-elevation lateral view, partially in section, of a second embodiment of the invention.
Figure 7:
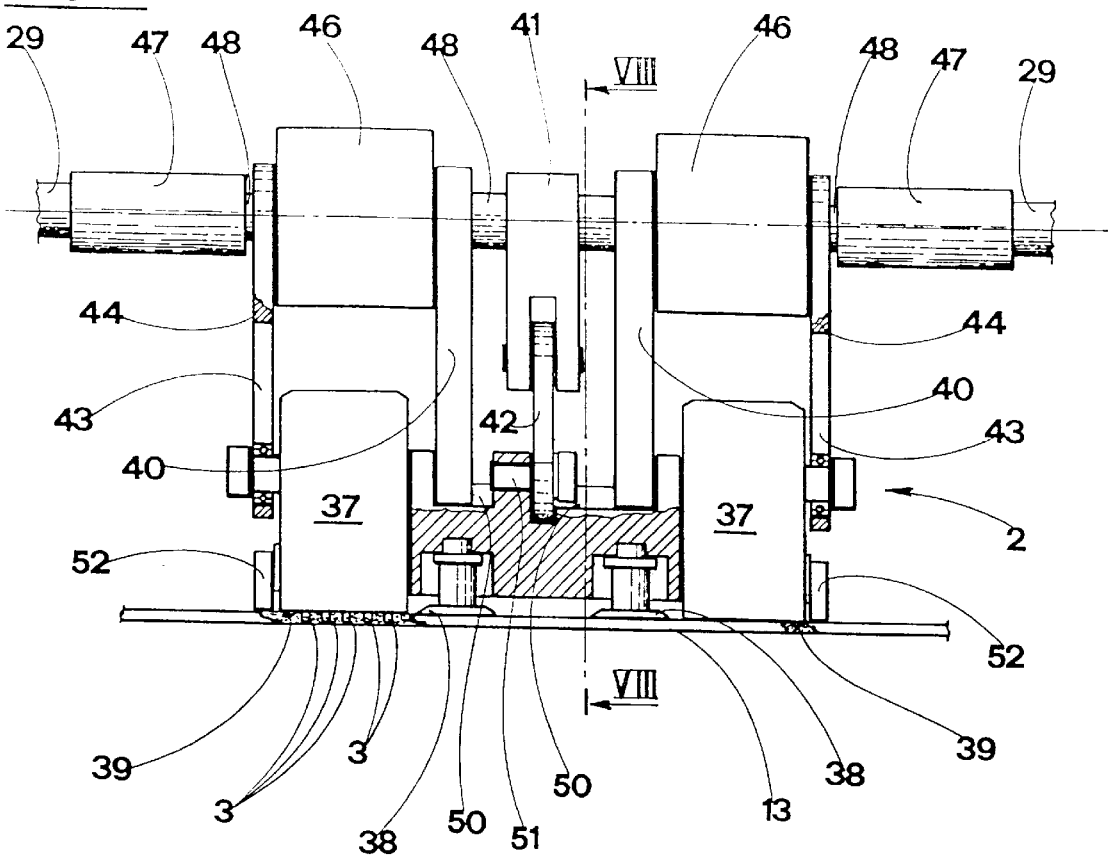
FIG. 7 is a schematic vertical-elevation frontal view of a third embodiment of the invention.

In a second embodiment of the invention, shown in FIG. 6, each head 2 comprises a roller 31 which on receiving a command rotates a pivot 32 parallel to the edge 4.

The external surface of the roller 31 bears a plurality of needles 3 arranged circumferentially at a same angular distance one from another. The needles 3 project and retract on command out of and into the surface of the roller 31. In each operative cycle the roller 31 nears the edge 4, rotates in the direction indicated by the arrow 35 and at the same time moves slightly (see arrow 33) towards the centre of the pile such that at least one needle 3 penetrates into the edge 4 and raises it.

A further embodiment of the invention, not illustrated in the figures of the drawings, provides each head 2 with two pairs of cursors 6 similar to the cursors 6 described hereinabove and arranged side-by-side. During a succession of operative cycles the cursors 6 act alternately.

The above is particularly advantageous in cases where, after the sheets have been raised from the pile 5, said sheets will be newly piled one on top of another in a successive work operation, thereafter to be pressed together to form laminates or panels. The use of two staggered couples of heads results in differently-positioned pierce-holes in the sheets, so that sheets which will then be united are unlikely to pucker or swell.

In FIGS. from 7 to 10 a still further embodiment of the invention is shown. It comprises a support frame 36 which supports a plurality of heads 2, which support frame 36 can be commanded to near and distance to and from the topmost sheet 13 of the pile. The means for moving the support frame 36 are of known type and therefore not illustrated in the drawing.

A main shaft 29 with horizontal rotation axis x is rotatably supported on the support frame 36. The shaft drive means are of known type and not illustrated in the drawings. A head 2 of the device is situated between one portion of shaft 29 and another.

Each head 2 is connected to the two portions of shaft by means of two joints (schematically represented in the drawings and denoted by 47), one for each portion of shaft 29. The joint 47 permits the head 2 to move vertically with respect to the relative portions of shaft 29. The joint can be, for example, a universal joint (that is, two universal joints in series combination).

Each head 2 bears two reciprocally-distanced needle-bearing groups 37, each of which comprises a cursor 6 on which a spring 7 operates. The cursor 6 bears at an end thereof at least one needle 3. The needles 3 preferably exhibit a flat shape, with an oval point, and are arranged in such a way that the longer side of the straight transversal section of the needle extends in a parallel direction to the sheet 13, that is, horizontally, as shown in FIG. 10. Tests have shown that this arrangement and conformation of the needles leads to excellent grip thereof on the sheet 13 and furthermore prevents the sheet 13 from tearing.

In the example each cursor 6 bears five needles 3 aligned parallel to the external side 4*a* of the edge 4 to be raised. The sliding direction of the cursor 6 on the relative needle-bearing group 37 is inclined by an angle $\alpha$—preferably about 30 degrees—with respect to the lie plane of the topmost sheet 13. The needles 3 are parallel to the sliding direction of the relative cursor 6. FIG. 10 clearly evidences how the action direction of each needle 3, in this embodiment, lies on an imaginary vertical plane perpendicular to the external side 4*a* of the edge 4 to be raised.

The spring 7 pushes the relative cursor 6 into an active position in which the needles 3 pierce into the topmost sheet 13.

A pneumatic cylinder 21 reloads the cursor 6; that is, the cursor is returned from the active position into an inactive position in contrast with the action of the spring 7.

The cylinder 21 also keeps the cursor 6 in the inactive position. The cylinder 21 is connected to the relative cursor 6 by means of a rocker arm 22 and a rod 23, in a similar way to that described in the first embodiment hereinabove. The cylinder 21 is connected to two sensors 52, constituted for example by two endrun stops arranged at opposite sides of the head 2 which signal to the cylinder 21 when the head is resting on both sides of the topmost sheet 13 of the pile 5.

Each head 2 is provided with at least one sucker 38 operatively associated to the edge 4. In the example the suckers 38 are two in number, divided between the needle-bearing groups 37. Not illustrated are known means for actuating the suckers 38.

Each head 2 is provided with at least one further needle 39, preferably cylindrical with a conical point, directly fixed on the body of the head 2 and projecting inferiorly from the head 2 by a quantity not greater than the breadth of a sheet. The fixed needle 39 is destined to pierce the topmost sheet 13 perpendicularly. The projection of the fixed needle 39 is adjustable. In the example each head 2 exhibits two fixed needles 39, each placed at a lateral end of a respective head 2.

Two slides 46 are associated to each head 2, slidingly coupled to the support frame 36 along vertical guides 49. The sliding of the slides 46 is commanded by known-type motor means (for example a pneumatic cylinder), not shown in the figures. Also provided are means for releasably blocking the slides 46 on the support frame 36.

Each head bears a pivot 50 having opposite ends rotatably coupled to the head 2. Two rocker arms 40, parallel and side by side, each present an end which is hinged to an intermediate shaft 48 coupled rotatably to the slides 46 and with a horizontal axis. The ends of the intermediate shaft 48 are connected to adjacent portions of shaft 29 by means of the universal joints 47.

The impact and piercing zone of the needles 3 in the edge 4 of the topmost sheet 13 is comprised between the external side 4*a* of the edge 4 and the pivot 50 on which the rocker arms 40 are hinged. The distance, measured in a horizontal direction normal to the external side 4*a*, between the axis of the pivot 50 and the piercing zone of the needles 3, is preferably not above about 5 cm.

A rod 41 is fixed by an end thereof to the intermediate shaft 48 and is hinged by an opposite end thereof to a con rod 42, which last is journalled to the head 2 by a horizontal pivot 51.

Each slide 46 bears a bracket 44. The head 2 is made to slide along two parallel curved guides 43, each arranged on a bracket 44. The guides 43, in the example constituted by a curved slot, partially parabolic in shape (see FIGS. 8 and 9), are conformed in such a way that following an upwards movement of the head 2 along the guides 46, the pivot 50 (together with the head 2) moves internalwise of the pile 5 of sheets. In other words, the pivot 50 distances from the external side 4*a*, which causes the rocker arm 40 to rotate with respect to the support frame 36 in the direction indicated by the arrows 45.

The device of FIGS. from 7 to 10, like that of FIGS. from 1 to 5, is provided with a system for dealing with uneven levels of the side 4 of the topmost sheet 13. In this case the adaptation for varying levels is permitted by the vertical mobility of the heads 2 with respect to the support frame 36 on the guides 49. This mobility is made possible, among other things, by the fact that the intermediate shaft 48 can perform small vertical movements with respect to the adjacent portions of main shaft 29.

There now follows a description of the functioning of the device of FIGS. from 7 to 10.

First the support frame 36 is positioned such that all the heads 2 are resting on the edge 4 to be raised. To ensure that all the heads 2 are resting, the slides 46 are pushed downwards by the motor. When a head 2 is resting on opposite sides of the topmost sheet 13—which situation is signalled by the relative sensors 52—the relative slides 46 are solidly blocked on the support frame 36. In this configuration the fixed needles 39 pierce the topmost sheet 13, such as to immobilize the topmost sheet 13 with respect to the heads 2.

At this point the cylinders 21 of each of the two needle-bearing groups 37 are deactivated, and consequently the springs 7 automatically bring the cursors 6 into the active position, the needles 3 having pierced into the side 4 with an angle of inclination $\alpha$.

The function of the fixed needles 39 is to prevent the impact of the inclined needles 3 on the topmost sheet 13 from causing an undesired movement. This displacement might indeed result in an imperfect grip on the topmost sheet 13 on the part of the needles 3.

Figure 8:
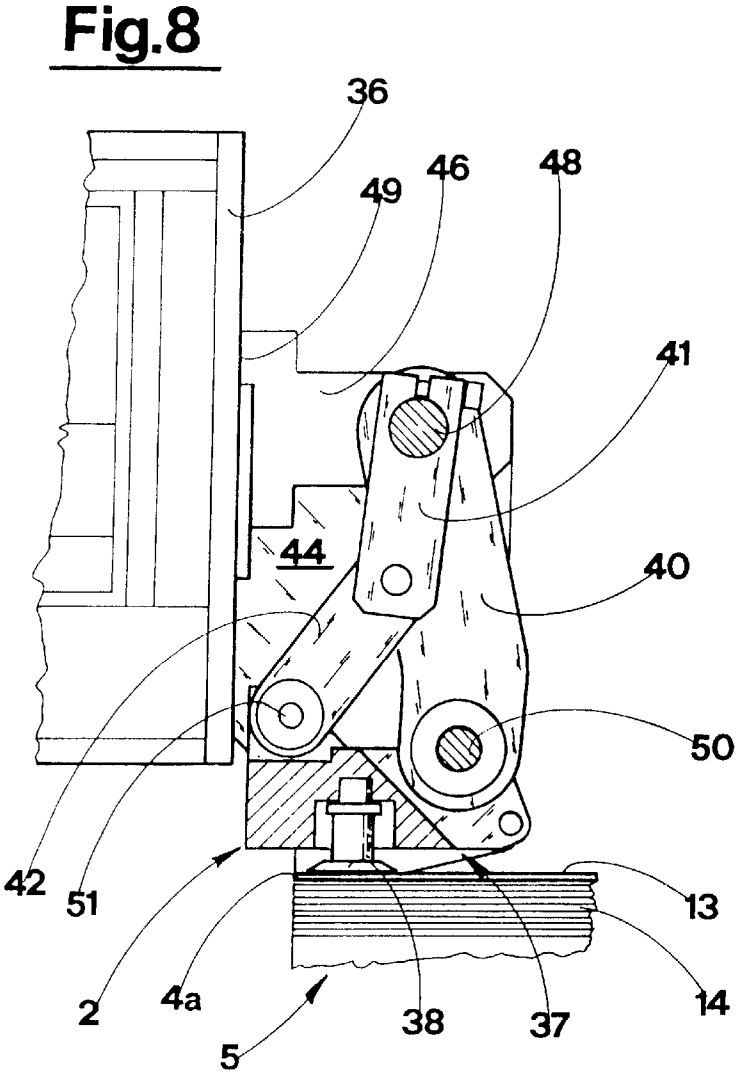
FIG. 8 is a section performed according to line VIII—VIII of FIG. 7.

Subsequently the main shaft 29 is rotated—that is, its various portions are rotated—in anticlockwise direction (with reference to FIG. 8). Thus the various intermediate shafts 48 rotate together with the main shaft 29 while the heads 2 begin to rise, taking with them the edge 4 of the topmost sheet 13. During this phase the heads 2 run on the respective curved guides 43. Thanks to the special grip of the needles 3, the edge 4 of the topmost sheet 13 detaches and distances from the immediately underlying sheet, even if the sheets are stuck one to another with considerable force.

Figure 9:
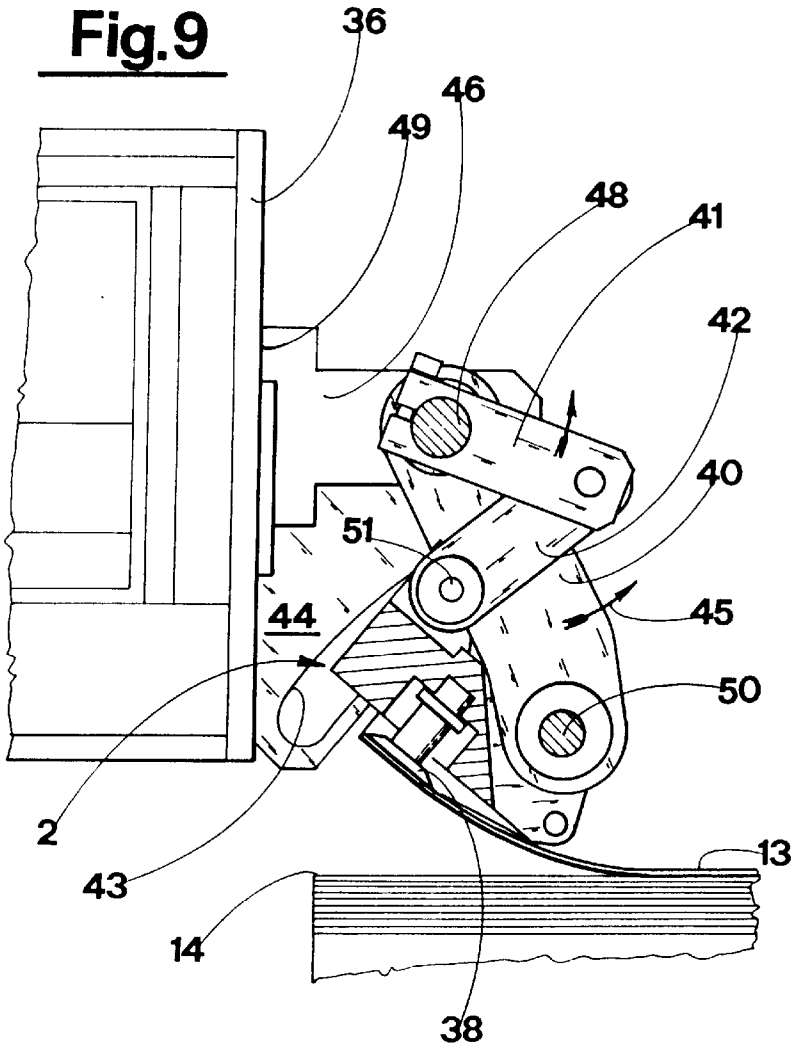
FIG. 9 is the section of FIG. 8, with the device in a different operative configuration.

As soon as this raising manoeuvre of the edge 4 has begun, the suckers 38 are activated, which collaborate with the needles 3 to maintain the edge 4 of the topmost sheet 13 attached to the heads 2, up until the configuration of FIG. 9 is achieved, in which the edge 4 is completely raised. Experiments have shown that cooperation between the suckers 38 and the needles 3 is extremely efficient and reliable in guaranteeing that grip of the edge 4 is maintained during the raising process.

During the raising phase of the edge 4 of the topmost sheet 13, each head 2 rotates about a relative pivot 50 and at the same time forces the pivot 50 itself to move backwards with respect to the external side 4*a* of the edge 4. The heads 2 thus rotate upwards and at the same time translate towards the centre of the pile 5 of sheets. Test have shown that this special composition of movements facilitates the grip of the needles 3 on the edge 4 and safeguards the paper from risk of tears.

Once the edge 4 has been raised, the topmost sheet 13 can be removed according to the modalities described with reference to the first embodiment hereinabove.

What is claimed:

1. A device for raising an edge of a topmost sheet of a pile of sheets, comprising at least one head provided with at least one needle;

the needle being mobile with respect to the head between an inactive position, in which the needle is in a retracted position inside the head, and an active position, in which the needle is advanced and projects from the head;

wherein, in the active position, said edge of the topmost sheet is piercable by the needle;

at least one sucker being mounted on said head, said sucker being destined to associate with said edge;

the head being movably mounted on a support whereby the needle and the sucker are movable, relative to the base, from a first position wherein the needle penetrates into the edge of the topmost sheet and the sucker is positioned to attract the edge of the topmost sheet, and a second position in which the needle and the sucker are raised with respect to said first position;

the head raising said edge of said topmost sheet during a movement from the first position into the second position;

said movement of the head from the first position to the second position comprising a rotation of the head about a rotation axis, said axis being substantially parallel to the edge to be raised of the topmost sheet.

2. The device of claim 1, wherein said movement of the head from said first position to said second position comprises said rotation of the head and further comprises a translation of the head, said translation being transverse to said edge and directed internalwise of said pile of sheets.

3. The device of claim 1, wherein said at least one needle is flat and includes an oval point.

4. A device for raising an edge of a topmost sheet of a pile of sheets, comprising:

a support frame;

at least one slide guide constrained to said support frame;

at least one head provided with at least one needle, said head being slidably constrained to said guide;

at least one sucker mounted on said head, said sucker being destined to associate with said edge;

at least one rocker arm, hinged by an end thereof to said support frame and by another end thereof to the head;

the head being mobile, with respect to said guide, to move the needle and the sucker from a first position thereof wherein the needle penetrates into the edge of the topmost sheet and wherein the sucker can attract the edge of the topmost sheet, and a second position thereof in which the needle and the sucker are raised with respect to said first position;

whereby, during a movement from the first position into the second position, the head raises said edge of said topmost sheet.

5. A device for raising an edge of a topmost sheet of a pile of sheets, comprising:

a support frame movable upon a command toward and away from said topmost sheet;

a main shaft which rotates on command about a horizontal rotation axis thereof and which is rotatably coupled with said support frame;

a plurality of heads aligned and parallel to said edge, said plurality of heads being constrained to said main shaft; each of said heads being provided with at least one needle;

at least one sucker mounted on each of said heads, said suckers being destined to associate with said edge;

the head being mobile to move the needle and the sucker from a first position thereof wherein the needle penetrates into the edge of the topmost sheet and the sucker can attract the edge of the topmost sheet, and a second position thereof in which the needle and the sucker are raised with respect to said first position;

whereby, during a movement from the first position into the second position, the head raises said edge of said topmost sheet;

at least one slide associated with said plurality of heads, said slide being vertically slidable on a second command with respect to said support frame;

at least one intermediate shaft associated with said plurality of heads, said intermediate shaft being slidably coupled with said at least one slide;

means for connecting said main shaft and the at least one intermediate shaft, said connecting means allowing small vertical displacements of said at least one intermediate shaft with respect to said main shaft;

each of said heads being movable with respect to said main shaft in a vertical direction, thereby to be adaptable to an unevenness in a lie plane defined by said topmost sheet.

6. A device for raising an edge of a topmost sheet of a pile of sheets, comprising at least one head provided with at least one needle;

the needle being mobile with respect to the head between an inactive position, in which the needle is in a retracted position inside the head, and an active position, in which the needle is advanced and projects from the head; wherein the needle pierces said edge of the topmost sheet in the active position;

the head being mounted on a support and being mobile with respect thereto to move the needle from a first position thereof wherein the needle penetrates into the topmost sheet at the edge thereof, and a second position thereof in which the needle is raised with respect to said first position;

the head raising said edge of said topmost sheet during a movement from the first position into the second position;

the device further comprising an elastic element operating between the head and the needle;

a motor being provided to bring said needle from said active position in to said inactive position;

a stop device being provided to block said needle in said inactive position in opposition to said elastic element, when said head is distanced from said topmost sheet, and to unblock said needle from said inactive position when said head is in proximity or contact with said topmost sheet of said pile of sheets.

7. The device of claim 6, comprising a tensed wire stretched parallel to said edge, said wire detaching said topmost sheet from underlying sheets in said pile of sheets, said wire being operable after said edge of said topmost sheet has been raised, said wire being passable on a third command between the topmost sheet and the underlying sheets starting from said edge.

8. The device of claim 7, comprising a blower for generating an air cushion between the topmost sheet and the underlying sheets after said wire has been passed through.

9. A device for raising an edge of a topmost sheet of a pile of sheets, comprising a plurality of heads each provided with at least one respective needle; wherein each of said heads being mobile to move said respective needle from a first position thereof wherein the needle penetrates into the topmost sheet at an edge thereof, and a second position thereof in which said needle is raised with respect to said first position; wherein during a movement from said first position into said second position, said head raises said edge of said topmost sheet;

said heads are aligned parallel to an external side of the topmost sheet of the pile of sheets;

each of said heads is mounted on a support and is vertically slidable with respect thereto between a lower position and an upper position, thereby to be adaptable to an unevenness in a lie plane defined by said topmost sheet;

elastic means for maintaining each of said heads in contact with said topmost sheet, said elastic means pushing the heads downwards to the lower position;

blocking means for releasably blocking each of said heads, with respect to said support, in any intermediate position between the lower position and the upper position.

10. The device of claim 9, wherein said movement of the head from said first position to said second position comprises:

a rotation of said at least one head about a rotation axis parallel to said edge of said topmost sheet to be raised; and a translation of said head transverse to said edge and directed internalwise of said pile of sheets.

* * * * *

UNITED STATES PATENT AND TRADEMARK OFFICE

CERTIFICATE OF CORRECTION

PATENT NO. : 5,951,001

DATED : September 14, 1999

INVENTOR(S) : Aristide STRADI

It is certified that error appears in the above-identified patent and that said Letters Patent is hereby corrected as shown below:

Title page, insert following new section:
--Related U.S. Application Data
Continuation-in-part of PCT application PCT/IT96/00202, November 29, 1995--
Column 1, between lines 2 and 3, insert the following:
--CROSS-REFERENCE TO RELATED APPLICATIONS
This is a continuation-in-part of PCT application no. PCT/IT95/00202, filed November 29, 1995.--

Signed and Sealed this

Eighteenth Day of July, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,951,001

DATED : September 14, 1999

INVENTOR(S) : Aristide Stradi

It is certified that error appears in the above-identified patent and that said Letters Patent is hereby corrected as shown below:

Column 2, line 30, change "10" to --10A--.

Figure 10A:
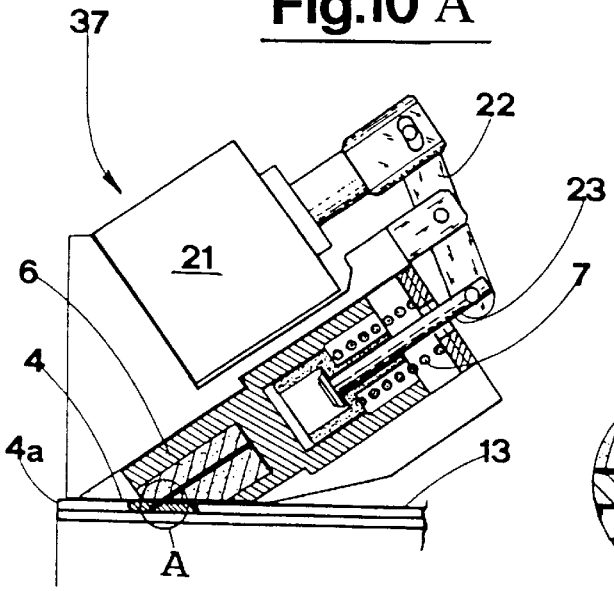
FIG. 10 is a vertical-elevation section of the needle-bearing device of FIG. 7.
Figure 10B:
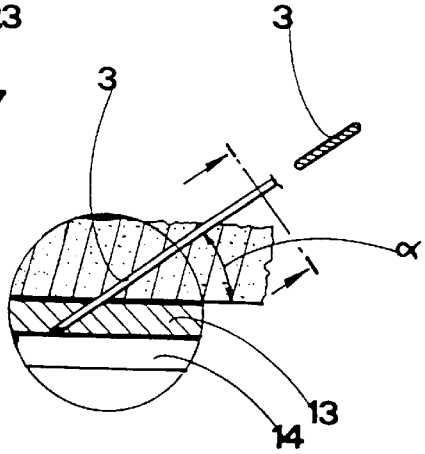

Column 2, after line 31, insert --FIG. 10B is an enlarged view of circled area A of FIG. 10.--.

Column 6, line 4, change "10" to --10A-10B--.

Column 6, line 30, change "FIG. 10" to --FIGS. 10A-10B--.

Column 7, line 40, change "10" to --10A-10B--.

Column 7, line 50, change "10" to --10A-10B--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*